US007748374B2

(12) United States Patent
Gnadinger

(10) Patent No.: US 7,748,374 B2
(45) Date of Patent: Jul. 6, 2010

(54) METHOD AND APPARATUS OF ASSEMBLING COOKING APPLIANCES

(75) Inventor: Errin Gnadinger, Louisville, KY (US)

(73) Assignee: General Electric Company, Schenectady, NY (US)

( * ) Notice: Subject to any disclaimer, the term of this patent is extended or adjusted under 35 U.S.C. 154(b) by 616 days.

(21) Appl. No.: 11/107,530

(22) Filed: Apr. 15, 2005

(65) Prior Publication Data

US 2006/0231085 A1 Oct. 19, 2006

(51) Int. Cl.
*F24C 3/00* (2006.01)

(52) U.S. Cl. ..... 126/39 N; 126/39 BA; 431/72

(58) Field of Classification Search ..... 126/39 N, 126/39 BA; 431/72, 12; 251/65
See application file for complete search history.

(56) References Cited

U.S. PATENT DOCUMENTS

| | | | | |
|---|---|---|---|---|
| 3,963,410 | A | 6/1976 | Baysinger | |
| 4,652,231 | A | 3/1987 | Berlincourt | |
| 4,681,084 | A * | 7/1987 | Grech | 126/52 |
| 4,688,547 | A * | 8/1987 | Ballard et al. | 126/116 A |
| 4,860,794 | A * | 8/1989 | Parrott et al. | 137/637.2 |
| 5,161,963 | A | 11/1992 | Berlincourt | |
| 5,458,294 | A | 10/1995 | Zachary et al. | |
| 5,544,856 | A | 8/1996 | King et al. | |
| 5,575,309 | A | 11/1996 | Connell | |
| 5,749,718 | A | 5/1998 | Berlincourt | |
| 5,785,511 | A | 7/1998 | Shah | |
| 5,813,320 | A | 9/1998 | Frasnetti et al. | |
| 6,003,543 | A | 12/1999 | Sulatisky et al. | |
| 6,030,205 | A | 2/2000 | Maughan | |
| 6,216,683 | B1 | 4/2001 | Maughan | |
| 6,217,312 | B1 | 4/2001 | Levinson et al. | |
| 6,422,533 | B1 * | 7/2002 | Harms | 251/129.1 |
| 6,796,326 | B2 | 9/2004 | Bayer | |
| 6,843,243 | B2 | 1/2005 | Steurer | |

FOREIGN PATENT DOCUMENTS

JP 362010510 A * 1/1987

* cited by examiner

*Primary Examiner*—Alfred Basichas
(74) *Attorney, Agent, or Firm*—George L. Rideout, Esq.; Armstrong Teasdale LLP

(57) ABSTRACT

A solenoid for controlling gas flow to a burner of an appliance includes at least one coil configured to receive an electrically charged pulse based on a signal sent from a controller. The solenoid also includes an armature moveable between a first position and a second position by the at least one coil. The armature is configured to remain in one of the first position and the second position until the coil receives the electrically charged pulse. Gas is flowing to the burner of the appliance when the armature is in the first position, and gas is restricted from flowing to the burner when the armature is in the second position.

7 Claims, 5 Drawing Sheets

METHOD AND APPARATUS OF ASSEMBLING COOKING APPLIANCES

BACKGROUND OF THE INVENTION

This invention relates generally to cooking appliances, and, more particularly, to methods and apparatus for assembling cooking appliances and controlling gas flow of cooking appliances.

Gas fired stoves, ovens, and ranges typically include one or more gas burners, and a main gas line coupled to the gas burners to providing fuel to the gas burners. At least some known cooking appliances include a solenoid valve to control the gas flow to the individual burners. These known cooking appliances include solenoids which require continuous power to control the flow of gas to the gas burners. Specifically, these known solenoids include an armature positionable in an open position and a closed position. To energize these solenoids, an electrical current is provided to the solenoid to produce a magnetic force to keep the armature in the open position, thus allowing gas to flow to the gas burner. When the electrical current is removed from the solenoid, the solenoid is de-energized, and a spring pushes the armature back to the closed position to block the gas flow. As such, the solenoid is continuously energized to supply gas to the gas burners.

Additionally, in these known cooking appliances a plurality of gas burners are typically used simultaneously. As such, each solenoid associated with the gas burners in use is energized at the same time. An undesirable high power supply is required to energize each solenoid to control the gas flow to the multiple burners, which increases the operating cost of the cooking appliance. In addition, as the temperature of the solenoid increases during the extended energizing of the solenoids, the heat is transferred to the gas flowing through the solenoid, thus decreasing the density of the gas flowing to the burners and lowering the output rate of the burners. Moreover, as a result of the increase in temperature of the solenoids, the solenoid coil resistance is also increased, thereby decreasing the electrical current and thus reducing the magnetic field produced by the coil. This may lead to de-activation of the solenoid, thus shutting off the flow of gas to the burner.

BRIEF DESCRIPTION OF THE INVENTION

In one aspect, a solenoid for controlling gas flow to a burner of an appliance is provided. The solenoid includes at least one coil configured to receive an electrically charged pulse based on a signal sent from a controller. The solenoid also includes an armature moveable between a first position and a second position by the at least one coil. The armature is configured to remain in one of the first position and the second position until the coil receives the electrically charged pulse. Gas is flowing to the burner of the appliance when the armature is in the first position, and gas is restricted from flowing to the burner when the armature is in the second position.

In another aspect, a cooking appliance is provided. The cooking appliance includes at least one gas burner, at least one solenoid configured to control the flow of gas to a corresponding one of the gas burners, and a controller operatively coupled to each solenoid. Each solenoid is operable in a first state wherein gas is flowing to the corresponding gas burner, and a second state wherein gas is restricted from flowing to the corresponding gas burner. The controller is configured to provide an electrical pulse to each solenoid to control the operation state of the solenoid.

In still another aspect, a method for assembling a cooking appliance is provided. The method includes providing at least one gas burner, coupling a gas supply line to each of the at least one gas burner, and coupling a solenoid to each gas supply line such that the solenoid controls the flow of gas to the respective gas burner. Each solenoid includes an armature moveable between a first position and a second position, and wherein gas is flowing to the burner of the appliance when the armature is in the first position, and gas is restricted from flowing to the burner when the armature is in the second position. Each solenoid also includes at least one coil configured to receive an electrically charged pulse. The method also includes coupling a controller to each solenoid to control the position of the armature of each solenoid, wherein the controller is configured to send electrically charged pulses to the at least one coil of each solenoid.

DETAILED DESCRIPTION OF THE INVENTION

Figure 1:
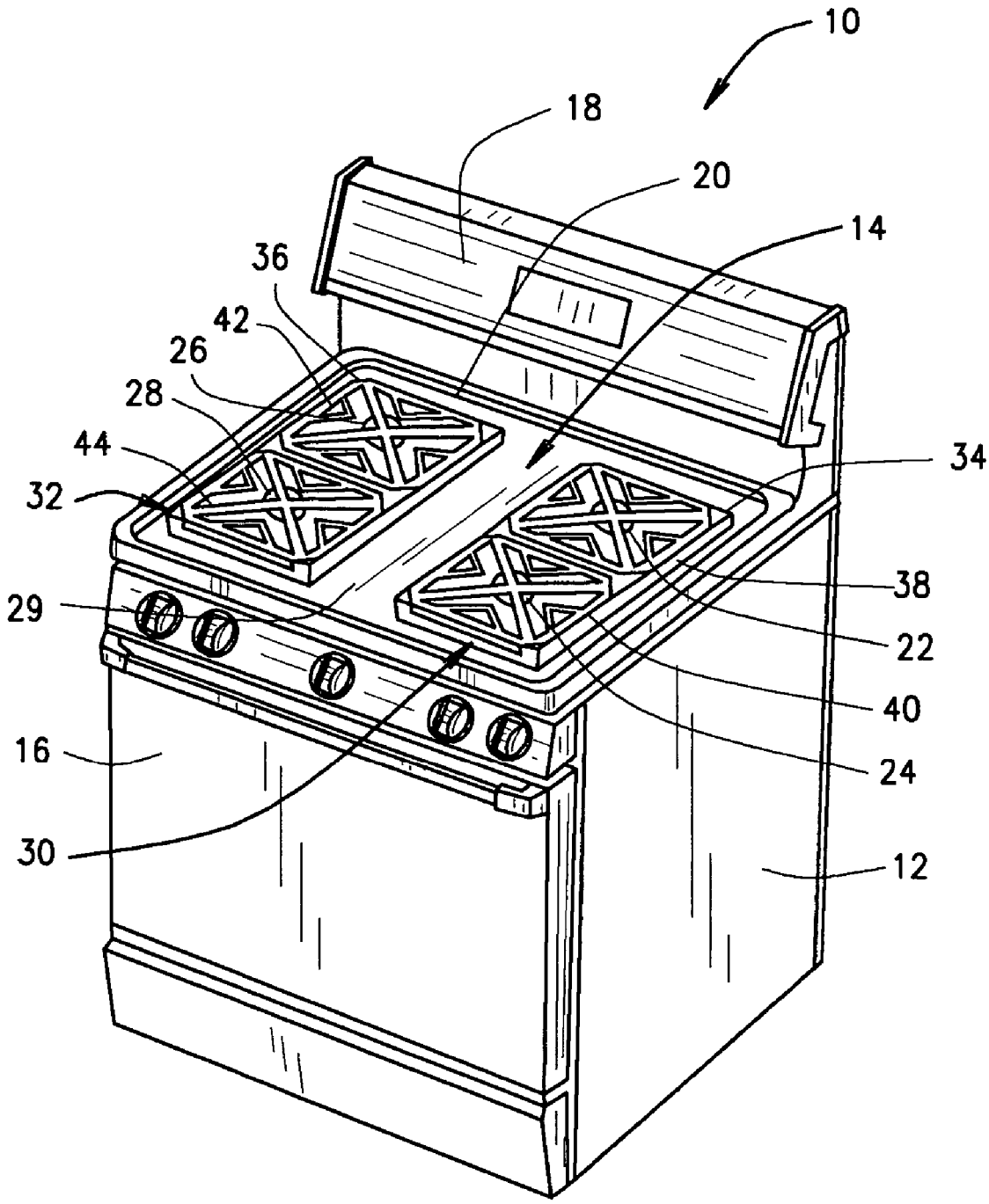
FIG. 1 is a perspective view of an exemplary gas range applicable to the present invention.

FIG. 1 illustrates a gas cooking appliance in the form of a free standing gas range 10 including an outer body or cabinet 12 that incorporates a generally rectangular cooktop 14. An oven, not shown, is positioned below cooktop 14 and has a front-opening access door 16. A range backsplash 18 extends upward of a rear edge 20 of cooktop 14 and contains various control selectors (not shown) for selecting operative features of heating elements for cooktop 14 and the oven. It is contemplated that the present invention is applicable, not only to cooktops which form the upper portion of a range, such as range 10, but to other forms of cooktops as well, such as, but not limited to, free standing cooktops that are mounted to kitchen counters. Therefore, gas range 10 is provided by way of illustration rather than limitation, and accordingly there is no intention to limit application of the present invention to any particular appliance or cooktop, such as range 10 or cooktop 14. In addition, it is contemplated that the present invention is applicable to dual fuel cooking appliances, e.g., a gas cooktop with an electric oven.

Cooktop 14 includes four gas fueled burners 22, 24, 26, 28 which are positioned in spaced apart pairs 22, 24 and 26, 28 and adjacent a respective side of cooktop 14. Each pair of burners 22, 24 and 26, 28 is surrounded by a recessed area (not shown in FIG. 1) respectively, of cooktop 14. The recessed areas are positioned below the upper surface 29 of cooktop 14 and serve to catch any spills from cooking utensils being used with cooktop 14. Each burner 22, 24, 26, 28 extends upwardly through an opening in cooktop 14, and a grate assembly 30, 32 is positioned over each respective pair of burners, 22, 24 and 26, 28. Each grate assembly 30, 32 includes a respective frame 34, 36, and separate utensil supporting grates 38, 40, 42, 44 are positioned above the cooktop recessed areas and overlie respective burners 22, 24, 26, 28 respectively.

The construction and operation of the range heating elements, including cooktop gas burners 22, 24, 26, 28 are believed to be within the purview of those in the art without further discussion.

Figure 2:
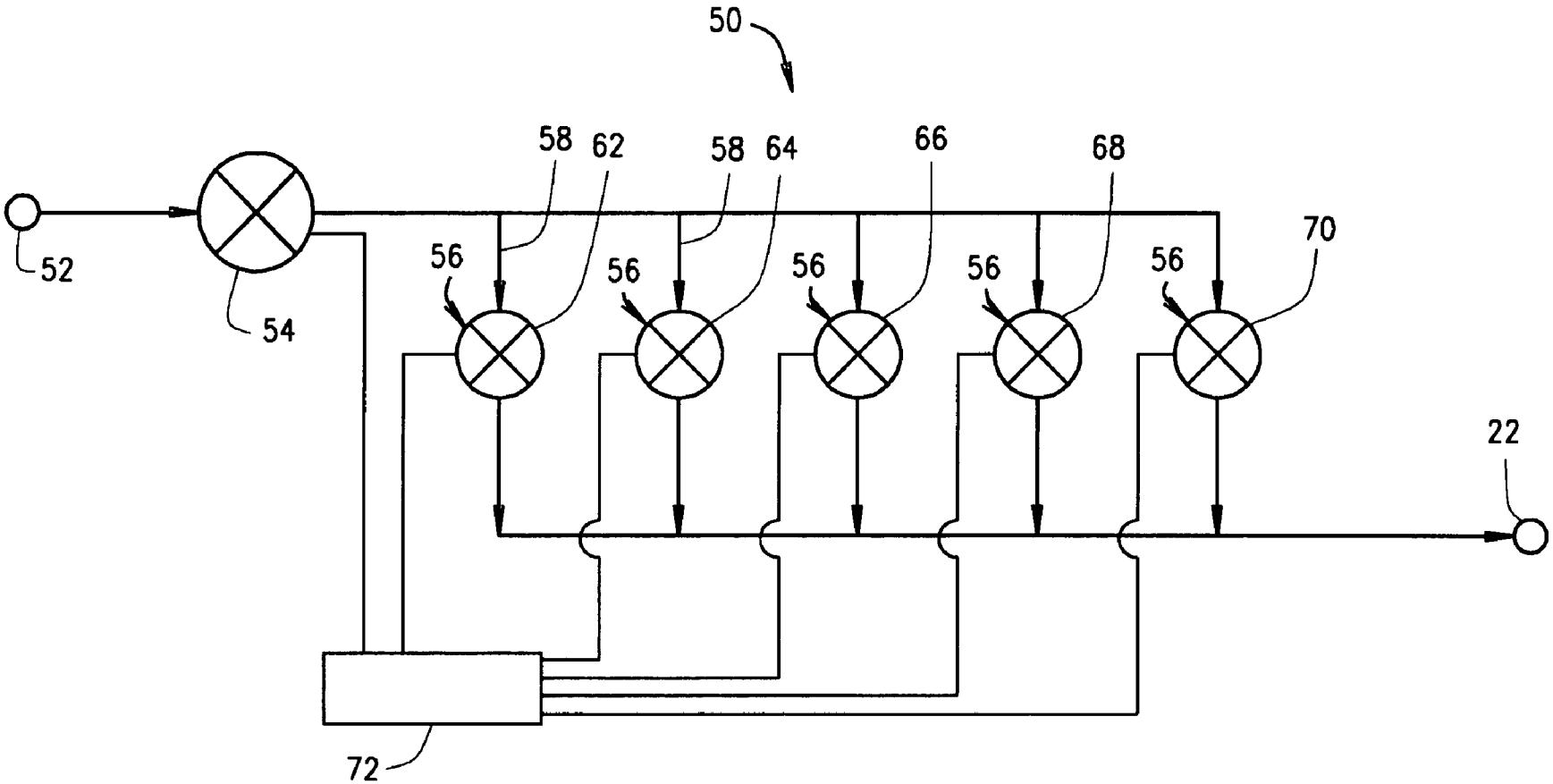
FIG. 2 is a schematic view of an exemplary gas valve assembly applicable to the gas range shown in FIG. 1.

FIG. 2 is a schematic view of an exemplary gas valve assembly 50 applicable to gas range 10 shown in FIG. 1. Gas valve assembly 50 controls the gas flow to burner 22. In the exemplary embodiment, gas valve assembly 50 includes a gas inlet 52 coupled with a main gas line (not shown) for introducing a flow of gas into gas valve assembly 50. Gas valve assembly 50 also includes a main solenoid 54 positioned downstream of gas inlet 52 for controlling the flow of gas through gas valve assembly 50. In the exemplary embodiment, main solenoid 54 is a standard, non-latching type, continuous power solenoid. In alternative embodiments, main solenoid 54 may be another type of valve for controlling the flow of gas through gas valve assembly 50.

Gas valve assembly 50 includes a plurality of burner solenoids 56. Each burner solenoid 56 is coupled to a respective gas conduit 58 in flow communication with a gas supply via main solenoid 54. In one embodiment, each burner solenoid 56 is a latching type solenoid, as described in detail below. In the exemplary embodiment, gas valve assembly 50 includes five burner solenoids 62, 64, 66, 68, 70 for controlling gas flow to burner 22. In alternative embodiments, more or less than five burner solenoids 56 may be provided, depending on the particular gas range 10. In the exemplary embodiment, a controller 72 is operatively coupled to main solenoid 54 and burner solenoids 56 for controlling the operational states thereof. In one embodiment, controller 72 is coupled to a power source and facilitates supplying power to main solenoid 54 and burner solenoids 56 to control the operational states thereof.

Main solenoid 54 controls the gas flow to solenoids 62, 64, 66, 68. Specifically, main solenoid 54 is operable in a first or open state of operation and a second or closed state of operation. In the first state of operation, power is supplied to main solenoid 54, and main solenoid 54 is energized. When main solenoid 54 is in the first state, gas flows to burner solenoids 56. In the second state of operation, power is not supplied to main solenoid 54, and main solenoid 54 is de-energized. When main solenoid 54 is operated in the second state, gas is restricted from flowing to burner solenoids 56.

Each burner solenoid 56 is individually operable and controls the gas flow to burner 22. Each burner solenoid 56 is operable in a first or open state of operation and a second or closed state of operation. In the first state of operation, power is supplied to any or all of burner solenoids 56, and respective burner solenoids 56 are energized. When burner solenoids 56 are in the first state, gas flows to burner 22. In the exemplary embodiment, each burner solenoid 56 has a predetermined gas flow rate there through when operated in the first state. As such, a predetermined amount of gas is allowed to flow to burners 22. In one embodiment, each of solenoids 62, 64 has a gas flow rate of 4.4 kilo British thermal units per hour (kBtu/hr), and each of solenoids 66, 68, 70 has a gas flow rate of 1.13 kBTU/hr. In alternative embodiments, each of solenoids 62, 64 have more or less than 4.4 kBTU/hr, and each of solenoids 66, 68, 70 has a gas flow rate of more or less than 1.13 kBTU/hr. In the second state of operation, power is not supplied to any of burner solenoids 56, and burner solenoids 56 are de-energized. When burner solenoids 56 is operated in the second state, gas is restricted from flowing to burner 22.

Moreover, gas range 10 includes additional gas valve assemblies 50 for controlling other burners, such as, for example, burners 24, 26, 28. Each gas valve assembly is operated in a substantially similar manner as described above to control the operation and gas flow to burners 24, 26, 28. In an alternative embodiment, gas valve assembly 50 controls the gas flow to each of burners 22, 24, 26, 28 instead of only one burner 22. Specifically, gas valve assembly 50 includes a single main solenoid 54 and multiple burner solenoid groups. Each solenoid group includes five burner solenoids 56 in a substantially similar configuration as described above, and each solenoid group controls the flow of gas to a corresponding one of burners 22, 24, 26, 28.

Figure 3:
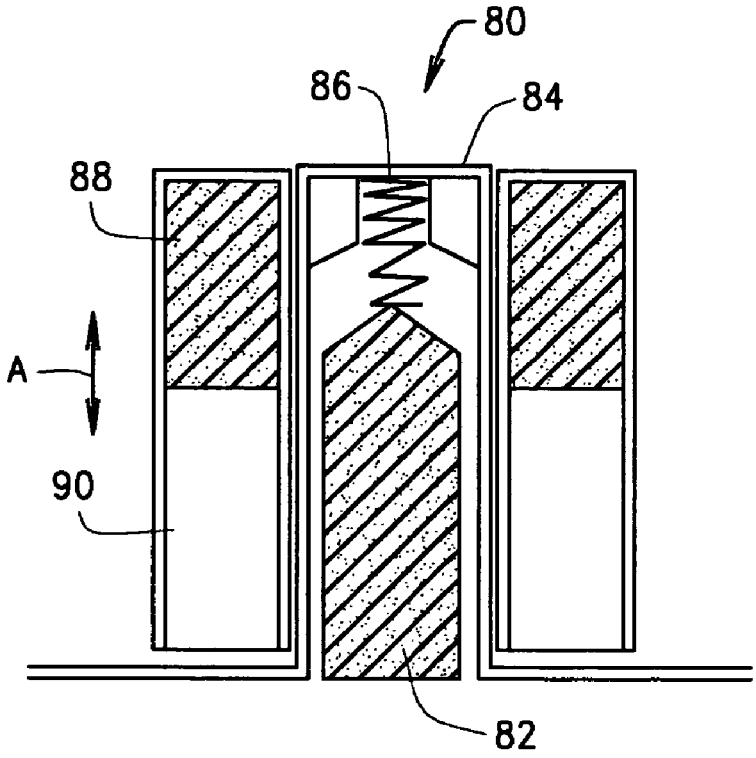
FIG. 3 is a cross-sectional view of an exemplary latching type solenoid applicable to the gas valve shown in FIG. 2.
Figure 4:
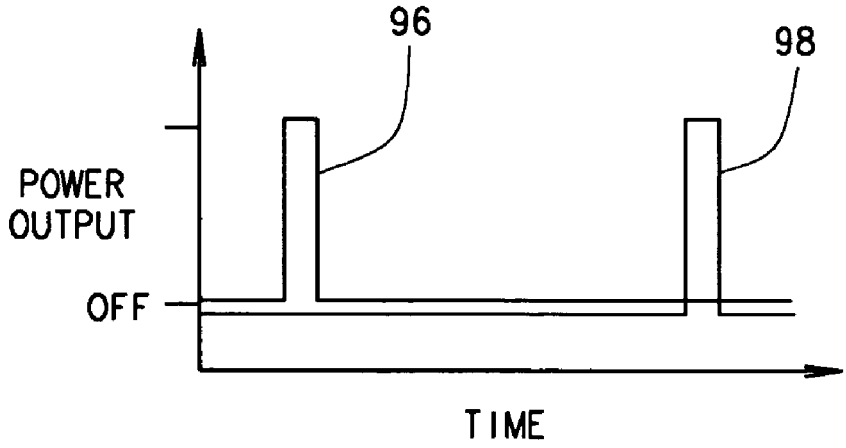
FIG. 4 is a diagram of electrical pulses provided to the latching type solenoid shown in FIG. 3.

FIG. 3 is a cross-sectional view of an exemplary solenoid 80 applicable to gas valve assembly 50 (shown in FIG. 2), and FIG. 4 is a diagram of electrical pulses provided to solenoid 80. In one embodiment, solenoid 80 is a burner solenoid 56 (shown in FIG. 2). In the exemplary embodiment, solenoid 80 includes an armature 82, a plug 84, a biasing member 86, a first coil 88, and a second coil 90.

Armature 82 is moveable into and out of the gas flow path to allow or restrict the flow of gas through gas conduit 58 (shown in FIG. 2). Specifically, armature 82 is movable between a first position and a second position, corresponding to the first state and second state of solenoid 80. More specifically, armature 82 is movable towards and away from plug 84, in the direction of arrow A. In one embodiment, armature 82 is fabricated from a metallic material have magnetic characteristics. Plug 84 is fabricated from a magnetically soft steel material, such that plug 84 can be temporarily magnetized. In another embodiment, plug 84 is fabricated from a weak permanent magnet such as, for example, a ceramic 5 magnet or an Aluminum Nickel, Cobalt (Alnico) permanent magnet.

In the exemplary embodiment, biasing member 86 is coupled to armature 82 and plug 84. Biasing member 86 facilitates biasing armature 82 away from plug 84 by exerting a force on armature 82. Moreover, biasing member 86 facilitates retaining armature 82 in position to restrict the flow of gas when armature 82 is in the second position.

First and second coils 88, 90, respectively, surround armature 82 along a longitudinal axis of armature 82. In the exemplary embodiment, first and second coils 88, 90 are wound in opposite directions such that, when each coil 88 or 90 is activated, an opposite magnetic field is created.

As described above, controller 72 (shown in FIG. 2) is operatively coupled with solenoid 80. Specifically, controller 72 supplies power to first and second coils 88, 90. When controller 72 sends an electrical pulse 96, such as for example, a positive phase electrical pulse, to first coil 88, coil 88 produces a first magnetic field to attract armature 82 and move it into the first position. In the first position, armature 82 is positioned adjacent plug 84 and solenoid 80 is operated in the first state. In the exemplary embodiment, solenoid 80 remains in the first state until receiving another electrical pulse from controller 72. Specifically, armature 82 is retained against plug 84 by a magnetic force between armature 82 and plug 84. Moreover, solenoid 80 does not require a continuous supply of power to coil 88 to retain armature 82 in the first position. As such, gas range 10 may include an electronic module that provides a smaller power supply, thus reducing the overall product cost of gas range 10. Additionally, an operating cost of gas range 10 may be reduced by requiring a reduced amount of power to operate. Moreover, solenoid 80 operates at a lower temperature as compared to known solenoids used in gas ranges. As a result, solenoid 80 facilitates reducing Btu decay as compared to known solenoids, thus providing an increased flow rate of gas to burner 22. Furthermore, solenoid 80 has a reduced risk of coil burnout and/or coil dropout as compared to known solenoids due to the reduced coil temperature. Specifically, the solenoids facilitate avoiding a loss of magnetic force during coil energizing due to a rise in the temperature of the solenoid, and further facilitates avoiding solenoid failure due to loss of magnetic force. Thus, solenoid 80 has an increased reliability as compared to known solenoids.

When controller 72 sends an electrical pulse 98, such as, for example, a positive phase electrical pulse, to coil 90, coil 90 produces a second magnetic field to attract armature 82 to move into the second position. Moreover, biasing member 86 facilitates moving armature 82 into the second position. In the second position, armature 82 is positioned a distance from plug 84 and blocks the flow of gas through gas conduit 58. Additionally, biasing member 86 facilitates retaining armature 82 in the second position.

Figure 5:
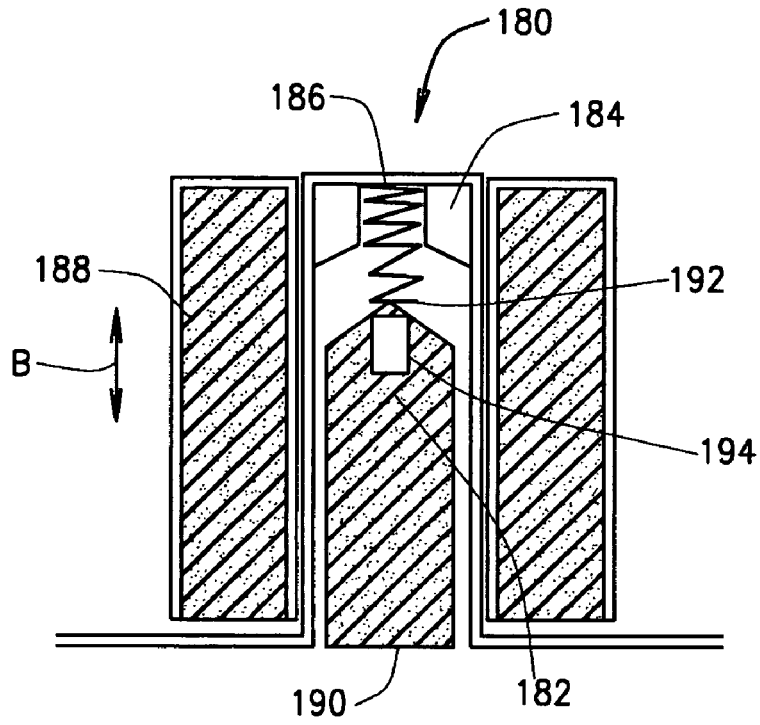
FIG. 5 is a cross-sectional view of another exemplary latching type solenoid applicable to the gas valve shown in FIG. 2.
Figure 6:
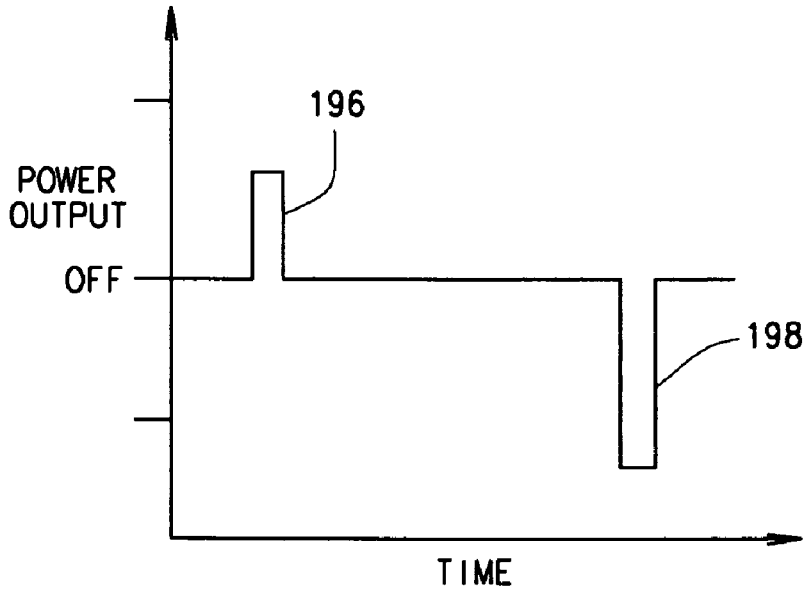
FIG. 6 is a diagram of electrical pulses provided to the latching type solenoid shown in FIG. 5.

FIG. 5 is a cross-sectional view of another exemplary solenoid 180 applicable to gas valve assembly 50 (shown in FIG. 2), and FIG. 6 is a diagram of electrical pulses provided to solenoid 180. In one embodiment, solenoid 180 is a burner solenoid 56 (shown in FIG. 2). In the exemplary embodiment, solenoid 180 includes an armature 182, a plug 184, a biasing member 186, and a coil 188 surrounding armature 182 along a longitudinal axis of armature 182.

Armature 182 is moveable into and out of the gas flow path to allow or restrict the flow of gas through gas conduit 58 (shown in FIG. 2). Specifically, armature 182 is movable between a first position and a second position, corresponding to the first state and second state of solenoid 180. More specifically, armature 182 is movable towards and away from plug 184, in the direction of arrow B. In one embodiment, armature 182 is fabricated from a metallic material and includes an armature body 190 having a plug end 192 closest to plug 184. Armature body 190 surrounds a magnetic core 194 within armature 182. In one embodiment, core 194 is encapsulated in armature body 190 during manufacture of armature 182. In another embodiment, core 194 is press fit into armature body 190 during manufacture of armature 182. In the exemplary embodiment, core 194 is positioned proximate plug end 192 of armature 182. In one embodiment, plug 184 is fabricated from a metallic material, such as, but not limited to, a steel material.

In the exemplary embodiment, biasing member 186 is coupled to armature plug end 192 and plug 184. Biasing member 186 facilitates biasing armature 182 away from plug 184 by exerting a force on armature 182. Moreover, biasing member 186 facilitates retaining armature 182 in position to restrict the flow of gas when armature 182 is in the second position.

As described above, controller 72 (shown in FIG. 2) is operatively coupled with solenoid 180. Specifically, controller 72 supplies power to coil 188. When controller 72 sends an electrical pulse 96, such as for example, a positive phase electrical pulse, to coil 188, coil 188 produces a first magnetic field to attract armature 182 to move into the first position. In the first position, armature 182 is positioned adjacent plug 184 and solenoid 180 is operated in the first state. In the exemplary embodiment, solenoid 180 remains in the first state until receiving another electrical pulse from controller 72. Specifically, armature 182 is retained against plug 184 by a magnetic force between armature magnetic core 194 and plug 184. Moreover, solenoid 180 does not require a continuous supply of power to coil 188 to retain armature 182 in the first position. As such, gas range 10 facilitates operating at a reduced cost by requiring a reduced amount of power to operate. When controller 72 sends an electrical pulse 98, such as, for example, a negative phase electrical pulse, to coil 188, coil 188 produces a second magnetic field to attract armature 182 to move into the second position. Moreover, biasing member 186 facilitates moving armature 182 into the second position. In the second position, armature 182 is positioned a distance from plug 184 and blocks the flow of gas through gas conduit 58. Additionally, biasing member 186 facilitates retaining armature 182 in the second position.

Figure 7:
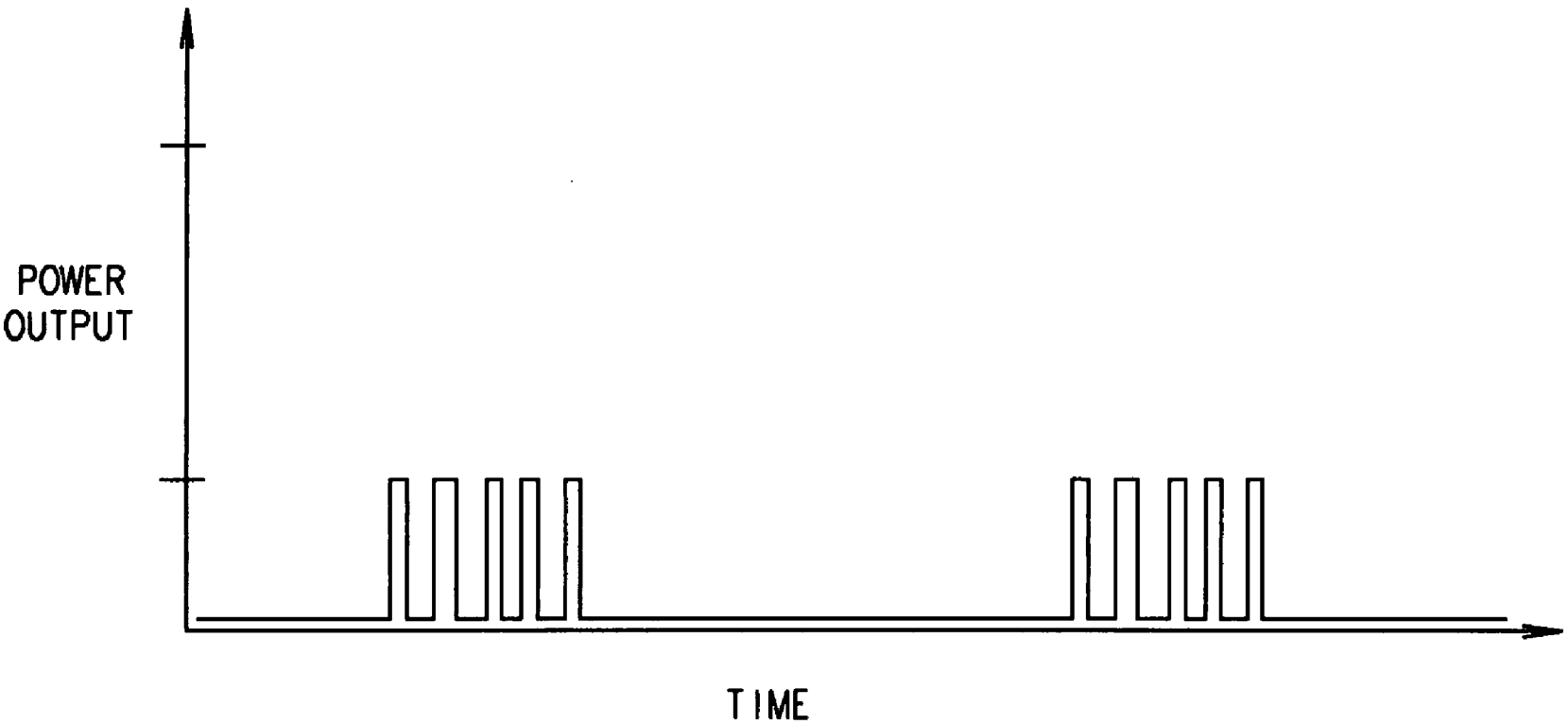
FIG. 7 is a diagram of electrical pulses provided to the gas valve assembly shown in FIG. 2.

FIG. 7 is a diagram of electrical pulses provided to gas valve assembly 50 (shown in FIG. 2). In the diagram, the vertical axis relates to a power output for operating solenoids 56 (shown in FIG. 2), wherein the output is measured in units such as, for example, Watts. The horizontal axis relates to time and is measured in units such as, for example, milliseconds.

In operation, controller 72 (shown in FIG. 2) energizes main solenoid 54 (shown in FIG. 2) to allow gas flow to burner solenoids 56 (shown in FIG. 2). Additionally, controller 72 provides electrical pulses to each of solenoids 62, 64, 66, 68, 70 (shown in FIG. 2) to control the operation states thereof. In the exemplary embodiment, controller 72 provides electrical pulses to solenoids 62, 64, 66, 68, 70 asynchronously to facilitate reducing a total amount of power used in operating gas range 10 (shown in FIG. 1). Specifically, controller 72 provides electrical pulses to only a single burner solenoid 56 at a given time. More specifically, controller 72 provides five electrical pulses to solenoids 62, 64, 66, 68, 70 in sequence, wherein each electrical pulse has a predetermined power output and time duration. In one embodiment, the power output to control each burner solenoid 56 is between approximately one and two Watts. In the exemplary embodiment, the power output to control each burner solenoid 56 is approximately one-and-a-half (1.5) Watts. As indicated above, the pulse may have either a positive or negative electrical charge, depending on the type of solenoid 56 used. Moreover, in one embodiment, the amount of time of each pulse to control each burner solenoid 56 is between approximately five and thirty milliseconds. In the exemplary embodiment, the amount of time of each pulse to control each burner solenoid 56 is between approximately ten and twenty milliseconds. Moreover, each sequential electrical pulse is spaced for an amount of time between approximately five and thirty milliseconds.

In operation, controller 72 provides the electrical pulses to solenoids 62, 64, 66, 68, 70 in a predetermined order. Specifically, in one embodiment, controller 72 provides electrical pulses to each of solenoids 62, 64, 66, 68, 70 to operate solenoids 62, 64, 66, 68, 70 in the first state. As such, gas range 10 is in the full on position, and a maximum amount of gas flow is provided to a respective burner, such as burner 22 (shown in FIG. 1). In another embodiment, controller 72 provides electrical pulses to each of solenoids 62, 64, 66, 68, 70 to operate solenoids 62, 64, 66, 68, 70 in the second state. As such, gas range 10 is in the full off position, and a minimum amount of gas flow is provided to a respective burner, such as burner 22. In yet another embodiment, controller 72 provides electrical pulses to less than all of solenoids 62, 64, 66, 68, 70 to change the operation state of the respective solenoids 62, 64, 66, 68, 70 to adjust the amount of gas flow to a respective burner, such as burner 22, to a flow that is between the minimum and maximum amount of gas flow. As such, controller 72 facilitates controlling an amount of gas flow to each burner by controlling the operational state and position of a plurality of burner solenoids 56. After the cooking process, controller 72 de-energizes main solenoid 54 to restrict gas from flowing to solenoids 62, 64, 66, 68, 70, and thus restricting gas from flowing to burners, such as burner 22.

A gas range is thus provided which controls gas flow to burners in a cost effective and reliable manner. The gas range includes a gas valve assembly having a plurality of burner solenoids for controlling gas flow to respective burners. In the exemplary embodiment, the controller provides electrical pulses to the burner solenoids asynchronously instead of simultaneously, which facilitates controlling the solenoids with a relative low power supply, and thus lowering the operating cost of the gas range. Moreover, the burner solenoids do not require a continuous flow of power to remain in an open position for allowing gas flow. As a result, the gas range may include an electronic module that provides a smaller power supply, thus reducing the overall product cost of the gas range. Additionally, an operating cost of the gas range may be reduced by requiring a reduced amount of power to operate. Moreover, the solenoid operates at a lower temperature as compared to known solenoids used in gas ranges. As a result, the solenoid facilitates reducing Btu decay as compared to known solenoids, thus providing an increased flow rate of gas to the respective burner. Furthermore, the solenoid has a reduced risk of coil burnout and/or coil dropout as compared to known solenoids due to the reduced coil temperature. Specifically, the solenoids facilitate avoiding a loss of magnetic force during coil energizing due to a rise in the temperature of the solenoid, and further facilitates avoiding solenoid failure due to loss of magnetic force. Thus, the solenoid has an increased reliability as compared to known solenoids.

While the invention has been described in terms of various specific embodiments, those skilled in the art will recognize that the invention can be practiced with modification within the spirit and scope of the claims.

What is claimed is:

1. A cooking appliance in flow communication with a source of gas, said cooking appliance comprising:

a plurality of gas burners; and a gas valve assembly coupled to a first gas burner of said plurality of gas burners, said gas valve assembly comprising:

a main solenoid coupled in flow communication with the source of gas;

a plurality of latching solenoids coupled to said main solenoid and to said first gas burner, each of said plurality of latching solenoids in flow communication with said main solenoid and said gas burner for controlling a flow of gas from said main solenoid to said gas burner, each latching solenoid of said plurality of latching solenoids comprising an armature operatively coupled to a plug, said armature movable in response to an electrical pulse between a first state wherein gas is flowing to said first gas burner and a second state wherein gas is restricted from flowing to said first gas burner, said armature magnetically attractable to said plug to maintain said armature in the first state; and a controller operatively coupled to each of said plurality of latching solenoids for controlling each latching solenoid such that each latching solenoid is operated individually, said controller configured to provide the electrical pulse to each latching solenoid to move each latching solenoid between the first state and the second state.

2. A cooking appliance in accordance with claim 1, wherein said main solenoid comprises a non-latching solenoid operable in a first state wherein gas is flowing to said plurality of latching solenoids and a second state wherein gas is restricted from flowing to said plurality of latching solenoids.

3. A cooking appliance in accordance with claim 1 wherein said controller is configured to provide electrical pulses to each latching solenoid asynchronously.

4. A cooking appliance in accordance with claim 1 wherein said controller is configured to provide a sequence of electrical pulses, each pulse in the sequence provided to a different one of said plurality of latching solenoids.

5. A cooking appliance in accordance with claim 1 wherein said armature is moveable between a first position and a second position, wherein said armature is in the first position in the first state and said armature is in the second position in the second state, and each latching solenoid comprises at least one coil configured to receive an electrically charged pulse from the controller to control the position of said armature, said armature configured to remain in one of the first position and the second position until said coil receives an electrically charged pulse.

6. A cooking appliance in accordance with claim 1 wherein said armature is moveable between a first position and a second position corresponding to the first and second states, and each latching solenoid comprises a first coil and a second coil such that, when said first coil is activated and receives an electrically charged pulse, said armature is moved to the first position, and when said second coil is activated and receives an electrically charged pulse, said armature is moved to the second position.

7. A cooking appliance in accordance with claim 1 wherein said armature is moveable between a first position and a second position corresponding to the first and second states, each latching solenoid comprises a single coil configured to receive a positive electrically charged pulse to move said armature to the first position and a negative electrically charged pulse to move said armature to the second position.

* * * * *